United States Patent [19]

Young

[11] 4,091,920

[45] May 30, 1978

[54] FLANGED CONTAINER

[75] Inventor: Harry E. Young, Maywood, Ill.

[73] Assignee: Container Corporation of America, Chicago, Ill.

[21] Appl. No.: 784,240

[22] Filed: Apr. 4, 1977

[51] Int. Cl.[2] ..... B65D 85/30

[52] U.S. Cl. ..... 206/320; 206/326; 206/491; 206/521

[58] Field of Search ..... 206/320, 326, 491, 521, 206/424, 312; 229/14 C, 40

[56] References Cited

U.S. PATENT DOCUMENTS

| | | | |
|---|---|---|---|
| 3,179,325 | 4/1965 | Johnson | 229/40 |
| 3,289,824 | 12/1966 | Boitel | 206/424 |
| 3,289,825 | 12/1966 | Smith | 206/320 |
| 3,302,851 | 2/1967 | Johnson | 229/40 |
| 3,325,964 | 6/1967 | Boitel | 229/40 |
| 3,445,054 | 5/1969 | Champlin | 206/424 |
| 3,516,593 | 6/1970 | Larsen | 206/424 |
| 3,680,688 | 8/1972 | Smith | 206/320 |
| 3,957,158 | 5/1976 | Poggiali | 206/320 |

*Primary Examiner*—William Price
*Assistant Examiner*—Bruce H. Bernstein
*Attorney, Agent, or Firm*—Carpenter & Ostis

[57] ABSTRACT

A container formed of a unitary blank of paperboard and including integral base and cover portions with interlocking flange portions for packing a flanged article such as a sink.

1 Claim, 4 Drawing Figures

FLANGED CONTAINER

SUMMARY OF THE INVENTION

This invention relates to paperboard shipping containers and more particularly to unitary containers of the type employed to package hollow flanged articles such as sinks.

It is an object of the invention to provide a container which will afford a maximum amount of protection for a hollow flanged article by affording protective clearances, structural integrity, easy closing means, and which will be nestable with like containers for efficient stacking and loading for transportation and storage.

A more specific object of the invention is to provide a container having base and cover portions with interlocking flanges.

These and other objects of the invention will be apparent from an examination of the following description and drawings.

THE DRAWINGS

It will be understood that, for purposes of clarity, certain elements may have been intentionally omitted from certain views where they are believed to be illustrated to better advantage in other views.

THE DESCRIPTION

Figure 1:
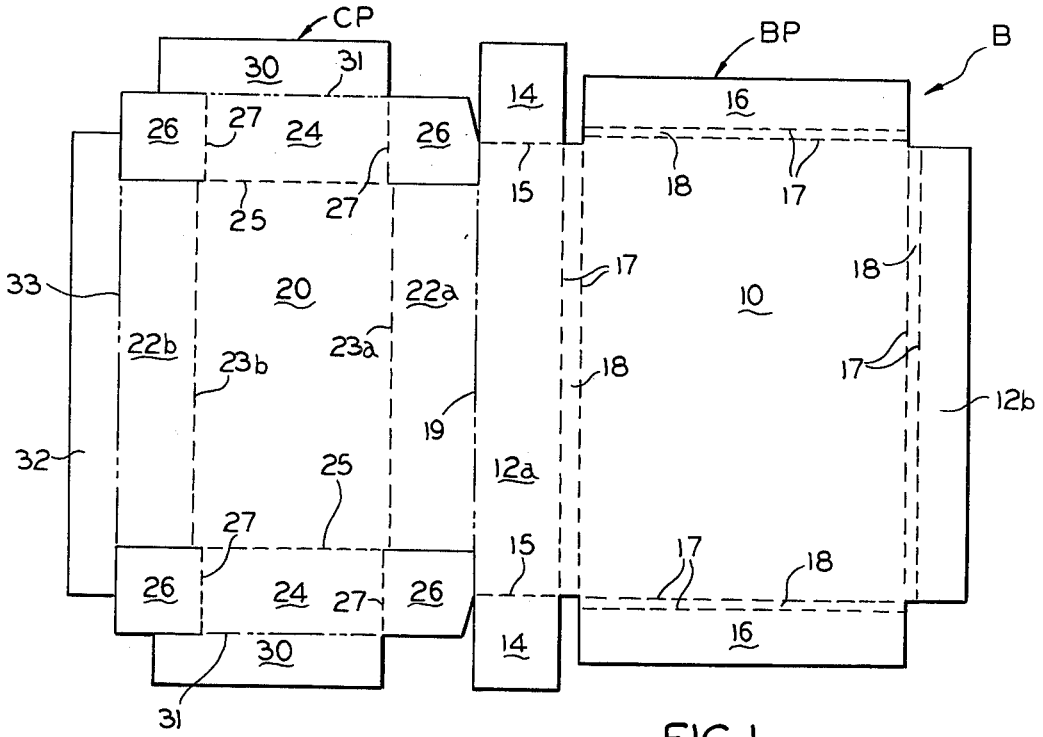
FIG. 1 is a plan view of the blank of paperboard from which the container embodying the invention, and illustrated in the other views, may be formed.

Referring now to the drawings for a better understanding of the invention, it will be seen that there is provided an improved shipping container indicated generally at C, which may be formed from a unitary blank B of foldable paperboard as illustrated in FIG. 1.

The container is employed to package an article such as a sink indicated generally at A, having a hollow body portion M, with a peripheral flange F extending outwardly therefrom.

The container includes a base portion BP and an integral cover portion CP adapted to fold over on top of the base portion and be secured thereto by an interlocking flange arrangement hereinafter described in order to house the article A and provide the structural integrity necessary to protect the article.

The base portion of the container includes a preferably rectangular flat base panel or bottom wall 10 which has foldably joined to opposite side edges thereof, a pair of first and second outer side flange panels 12*a* and 12*b*, respectively, and which has foldably joined to its opposed end edges a pair of outer end flange panels 16. The first outer side flange panel 12*a* has foldably joined to its opposite end edges, a pair of end flaps 14 which are joined to the outer side flange panel on fold lines 15.

The outer side flange panels and the outer end flange panels are each joined to the respective edges of base panel 10 by a pair of parallel fold lines 17 which form a narrow connecting panel or strip 18 therebetween.

The integral cover portion of the container includes a preferably rectangular top panel or wall 20 and a pair of first and second side panels or walls 22*a* and 22*b* foldably joined to opposed side edges thereto along fold lines 23*a* and 23*b* respectively. A pair of end panel or walls 24 are foldably joined along fold lines 25 to opposite end edges of top panel 20. Each of the end panels 24 have foldably joined to opposite sides thereto on fold lines 27, a pair of side flaps 26. Also, each of the end panels 24 have foldably joined to their end edges along fold lines 31 a pair of inner end flange panels 30. Second side panel 22*b* has foldably joined to its side edge along fold line 33 an inner side flange panel 32; while the lower edge of first side wall 22*a* is foldably joined along fold line 19 to the adjacent side edge of the base portion first outer side flange panel 12*a*.

Figure 2:
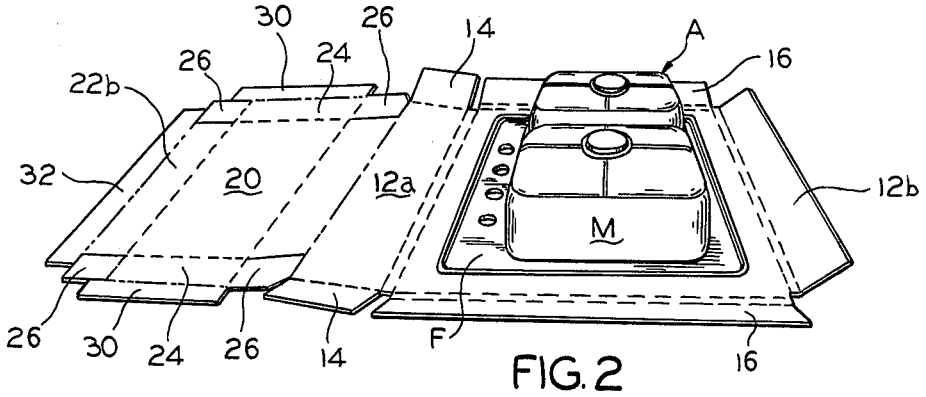
FIG. 2 is a perspective view of the container, shown prior to closing, with the packaged article in place.
Figure 3:
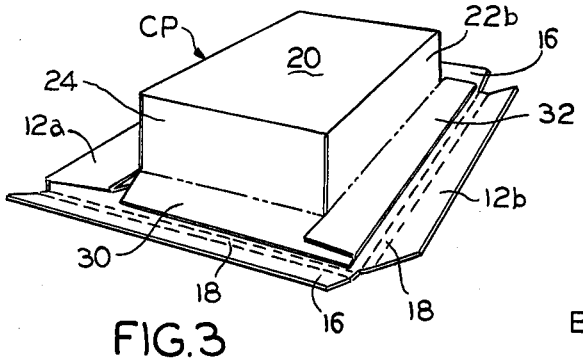
FIG. 3 is a perspective view of the container in a partially erected condition, but shown prior to the closing of the flanges.
Figure 4:
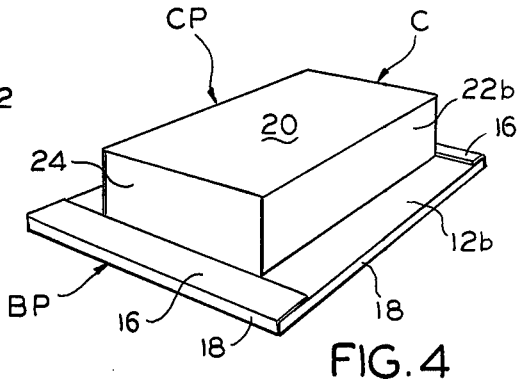
FIG. 4 is a perspective view of a completely erected and closed container.

Referring now to FIGS. 2 through 4 where the loading, erecting and closing sequence of the container is shown, it will be seen that the article is placed in an inverted position on base panel 10 with the flange F of the article lying in face contact with upper or inner surface of base panel 10 and with the body portion M of the article extending upwardly from the flange.

To erect and close the carton, the cover portion is folded to the position shown in FIG. 3 with the cover side and end walls extending downwardly from the top panel 20 to form a box-like container over the packaged article and with the inner side and end flanges 32 and 30 respectively of the cover portion folded outwardly from the side and end walls to lie over the flanges of the packaged article in parallel relation with base panel 10 and with the side flaps 26 folded inwardly at right angles to lie behind the cover portion side walls. At this point the end flaps 14 of the outer side flange panel 12*a* are tucked under the outer side flange panel 12*a* which is disposed in face contact with the flange at one side of the article, there being no inner side flange panel at that side of the container.

At this point the container is in the position shown in FIG. 3 whereby to finish closing the container, the second outer side flange panel 12*b* is folded 180° inwardly to overlie the inner side flange panel 32 and the outer end flange panels 16 are folded inwardly 180° to overlie the inner end flange panels 30, and end portions of the inner side flange panel 32 and the first outer side flange panel 12. The outer side and end flange panels are preferably adhesively secured to the respective inner flange panels.

Thus it will be seen that there is provided a one piece container structure which snugly engages the packaged article so as to eliminate the need for separate inner packaging pieces, which provides a rigid structure, and which is capable of nesting with like packages to provide an efficient arrangement for transportation or storage of the packages.

I claim:

1. In a form fitting shipping container, for a hollow flanged article such as a sink having a height and a width, formed from a unitary blank of foldable paperboard, the combination of:

(a) a base portion including a generally rectangular flat base panel receiving said article in an inverted position with the flanges of said article in face contact with said base panel, and with the body portion of said article extending upwardly from said flanges;

(b) an integral, hollow, cover portion disposed on said base panel over said article and including:

(i) a top panel having opposed pairs of side and end panels depending from opposed side and end edges of said top panel, said pairs of panels being of sufficient length to space said top panel from said base at least the height of said article;

(ii) certain of said side and end panels having foldably joined to their respective lower edges inner side and end flange panels extending normal thereto and overlying certain flanges of said article and being of sufficient length to span the distance from said article to an edge of said container so as to prevent the edges of said article from contacting the edges of said container said length being greater than the width of said article:

(c) said base portion also including opposed pairs of outer side and end flange panels of approximately the same length as said inner flange panels of said cover portion and being foldably joined to opposed side and end edges of said base panel and folded inwardly to overlie and be secured to said cover portion inner flange panels.

* * * * *

UNITED STATES PATENT OFFICE

CERTIFICATE OF CORRECTION

Patent No. 4,091, 920 Dated May 30, 1978

Inventor(s) Harry E. Young

It is certified that error appears in the above-identified patent and that said Letters Patent are hereby corrected as shown below:

The title page should be deleted and substituted with the attached title page therefore.

Signed and Sealed this

*Fourteenth* Day of *November 1978*

[SEAL]

*Attest:*

RUTH C. MASON
*Attesting Officer*

DONALD W. BANNER
*Commissioner of Patents and Trademarks*

United States Patent [19]

Young

[11] 4,091,920

[45] May 30, 1978

[54] FLANGED CONTAINER

[75] Inventor: Harry E. Young, Maywood, Ill.

[73] Assignee: Container Corporation of America, Chicago, Ill.

[21] Appl. No.: 784,240

[22] Filed: Apr. 4, 1977

[51] Int. Cl.[2] ..... B65D 85/30

[52] U.S. Cl. ..... 206/320; 206/326; 206/491; 206/521

[58] Field of Search ..... 206/320, 326, 491, 521, 206/424, 312; 229/14 C, 40

[56] References Cited

U.S. PATENT DOCUMENTS

| | | | |
|---|---|---|---|
| 3,179,325 | 4/1965 | Johnson | 229/40 |
| 3,289,824 | 12/1966 | Boitel | 206/424 |
| 3,289,825 | 12/1966 | Smith | 206/320 |
| 3,302,851 | 2/1967 | Johnson | 229/40 |
| 3,325,964 | 6/1967 | Boitel | 229/40 |
| 3,445,054 | 5/1969 | Champlin | 206/424 |
| 3,516,593 | 6/1970 | Larsen | 206/424 |
| 3,680,688 | 8/1972 | Smith | 206/320 |
| 3,957,158 | 5/1976 | Poggiali | 206/320 |

*Primary Examiner*—William Price
*Assistant Examiner*—Bruce H. Bernstein
*Attorney, Agent, or Firm*—Carpenter & Ostis

[57] ABSTRACT

A container formed of a unitary blank of paperboard and including integral base and cover portions with interlocking flange portions for packing a flanged article such as a sink.

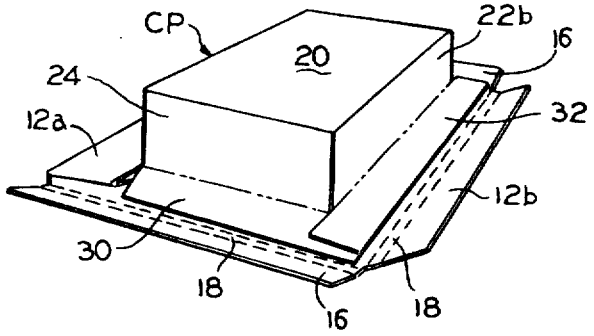

1 Claim, 4 Drawing Figures